US007770634B2

(12) United States Patent
Lei et al.

(10) Patent No.: US 7,770,634 B2
(45) Date of Patent: Aug. 10, 2010

(54) GAS LIFT APPARATUS FOR FLUSHING AND SNUBBING WELL

(75) Inventors: Yu Lei, Shanshan (CN); Yong Li, Shanshan (CN); Qiang Wang, Shanshan (CN); Zhenghua Wu, Shanshan (CN); Zhimin Xu, Shanshan (CN); Zhensong Wang, Shanshan (CN); Meijuan Suo, Shanshan (CN)

(73) Assignee: Development & Research Center of Tuha Petroleum Exploration & Development Corporation, Shanshan, Xinjiang (CN)

( * ) Notice: Subject to any disclaimer, the term of this patent is extended or adjusted under 35 U.S.C. 154(b) by 99 days.

(21) Appl. No.: 12/250,511

(22) Filed: Oct. 13, 2008

(65) Prior Publication Data

US 2009/0114383 A1 May 7, 2009

(30) Foreign Application Priority Data

Nov. 1, 2007 (CN) ..... 2007 2 0173936

(51) Int. Cl.
*E21B 43/16* (2006.01)

(52) U.S. Cl. ..... 166/68; 166/117.5; 166/131; 166/372

(58) Field of Classification Search ..... 166/68, 166/115, 117.5, 131, 184, 372

See application file for complete search history.

(56) References Cited

U.S. PATENT DOCUMENTS 3,059,696 A * 10/1962 Lindsey ..... 166/250.08
3,642,070 A * 2/1972 Taylor et al. ..... 166/372
4,718,496 A * 1/1988 Tompkins et al. ..... 166/387
5,343,945 A * 9/1994 Weingarten et al. ..... 166/105.5
7,063,152 B2 * 6/2006 Yeo et al. ..... 166/285

* cited by examiner

*Primary Examiner*—Hoang Dang
(74) *Attorney, Agent, or Firm*—Helen S. Liu

(57) ABSTRACT

A gas lift production apparatus is provided for use in flushing and snubbing well operation. The apparatus comprises upper production string and lower production string. The upper production string includes at least one side pocket mandrel carrying a gas lift valve, tubular strings connected with every side pocket mandrel, a sliding sleeve installed as part of the production string below side pocket mandrels and a latch seal assembly threaded in the tubular string below the sliding sleeve. The lower production string includes a single bore packer below the latch seal assembly, tubular strings, a landing nipple and a bell mouth at the bottom of the production string. The upper production string are run in and removed as a single unit from the packer which is anchored within the well casing. It is emphasized that this apparatus is provided with three functions such as producing a gas lift well, flushing well and snubbing well operation. Application of the apparatus will prevent flushing or killing fluid from polluting the reservoir and increase production efficiency.

12 Claims, 4 Drawing Sheets

GAS LIFT APPARATUS FOR FLUSHING AND SNUBBING WELL

CROSS REFERENCE TO RELATED APPLICATION

This application claims priority to and the benefit of Chinese Patent Application Serial No. 200720173936.X, filed on Nov. 1, 2007, the disclosure of which is incorporated by reference in its entirety.

FIELD OF THE INVENTION

The present invention relates generally to well completion and production, and in particular to a gas lift apparatus for producing, flushing and snubbing a well.

BACKGROUND OF THE INVENTION

Conventional gas lift apparatus is only provided with gas lift completion. If well flushing or well killing is operated in an oil well with conventional gas lift apparatus, flushing fluid or killing fluid will pour into reservoir. As a result, one side the effect of well flushing and well killing will be tampered; the other side recovery time for the output of the oil well and blowing period will become longer. It is worse that the reservoir will be polluted. So that gas lift apparatus for flushing and snubbing was invented to resolve above-mentioned problems.

SUMMARY

One aspect of the present invention is the provision of a gas lift apparatus, namely tubing production string, for use in well completion and production, comprising: (1) at least one side pocket mandrel carrying a gas lift valve, adapted for injecting gas into the oil well, (2) several tubular string threaded in the both ends of every said side pocket mandrel, (3) a sliding sleeve connected with the tubular string below the lowest side pocket mandrel for providing a convenient way to establish or shut off communication between the tubing and annulus, (4) a latch seal assembly mounted in the tubular string below the sliding sleeve and inserted into a single-bore packer for connecting the upper production string with the lower production string (5) a single-bore packer directly joined with the latch seal assembly and anchored within the well casing for sealing the annulus between the tubing and the casing, (6) a landing nipple connected with the tubular string below the packer for setting all kinds of flow control devices such as tubing-retrievable check valve and tubing-retrievable plug, (7) a bell mouth mounted in the tubular string below the landing nipple and installed as a part of the tubular string at the bottom of the tubing production string.

Another aspect of the present invention is the provision of a flushing apparatus in a gas lift well. In the present invention, a tubing-retrievable check valve is set in the landing nipple to prevent the backflow of the flushing fluid for the purpose of protecting the reservoir in the process of well flushing operation.

Yet another aspect of the present invention is the provision of a snubbing apparatus in a gas lift well. In the present invention, a tubing-retrievable plug is landed within the landing nipple to close communication between the tubing production string and the reservoir for operating snubbing well.

Other or alternative features will be apparent from the following description of presently preferred embodiments of the invention, given for the purpose of disclosure, and taken in conjunction with the accompanying drawings.

The gas lift production apparatus of the present invention is provided for use in flushing and snubbing well operation. The apparatus comprises upper production string and lower production string. The upper production string includes at least one side pocket mandrel carrying a gas lift valve, tubular strings connected with every side pocket mandrel, a sliding sleeve installed as part of the production string below side pocket mandrels and a latch seal assembly threaded in the tubular string below the sliding sleeve. The lower production string includes a single bore packer below the latch seal assembly, tubular strings, a landing nipple and a bell mouth at the bottom of the production string. The upper production string are run in and removed as a single unit from the packer which is anchored within the well casing. It is emphasized that this apparatus is provided with three functions such as producing a gas lift well, flushing well and snubbing well operation.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
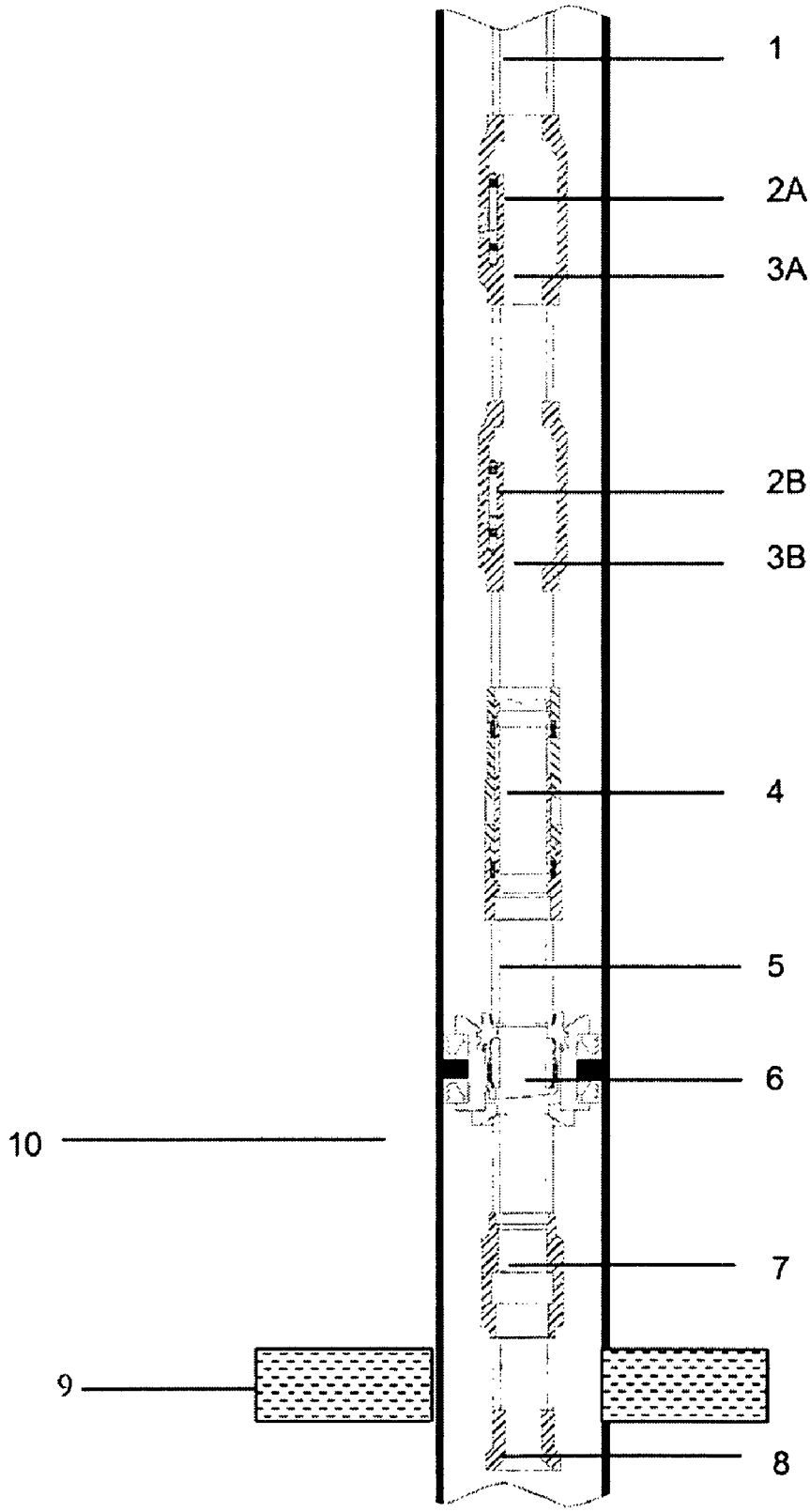
FIG. 1 is a view of a typical gas lift completion and production apparatus of the present invention, in which a latch seal assembly has been landed within a single bore packer and the sliding sleeve has been closed.

Referring now to FIG. 1, a gas lift completion and production apparatus of the present invention is illustrated, in which more than one gas lift valves 2A and 2B installed inside pocket mandrels 3A and 3B forms a single unit for communicating an injection gas from the surface to the perforation interval. Any type of gas lift valve may be employed in this operation including, but not limited to, injection pressure operated valves, production pressure operated valves, and other gas lift valves.

The side pocket mandrels 3A and 3B as a injection tool are connected with a tubing production string 1 at appropriate depth in the well bore. The side pocket mandrel 3A or 3B features a single side pocket used to install retrievable gas lift valve 2A or 2B respectively. The bore of the side pocket will communicate between the tubing and the annulus. Injection gas from the annulus is injected into the tubing production string 1 via bores of the side pocket mandrel 3A and 3B and the gas lift valve 2A and 2B. In fact, the side pocket mandrel 3A and 3B may be displaced with a tubing-retrievable mandrel, a pipe or other conduit.

During the gas lift production of operation, a sliding sleeve 4 is closed and mounted in the production tubing string 1 below side pocket mandrels 3A and 3B. It provides communication between the tubing and casing annulus by means of standard wire-line methods.

During the gas lift production of operation, a latch seal assembly 5 is installed as part of the tubing below the sliding sleeve 4 for sealing and locking the upper tubing production string 1 to the packer 6.

In the gas lift production apparatus of the present invention, the formation 9 is sealed using a single bore packer 6 with the latch seal assembly 5 in the well bore at a location above the perforation interval. The packer 6 has actuated slips to set securely in the casing 10, seal elements to seal the casing annulus.

In the gas lift production apparatus of the present invention, a landing nipple 7 is mounted in the tubing production string 1 below the packer 6 for setting tubing-retrievable check valve and tubing-retrievable plug. However, there is not any flow control device in the landing nipple 7 in FIG. 1. In addition, a bell mouth 8 is installed as the bottom joint of the tubing production string 1.

Figure 2A:
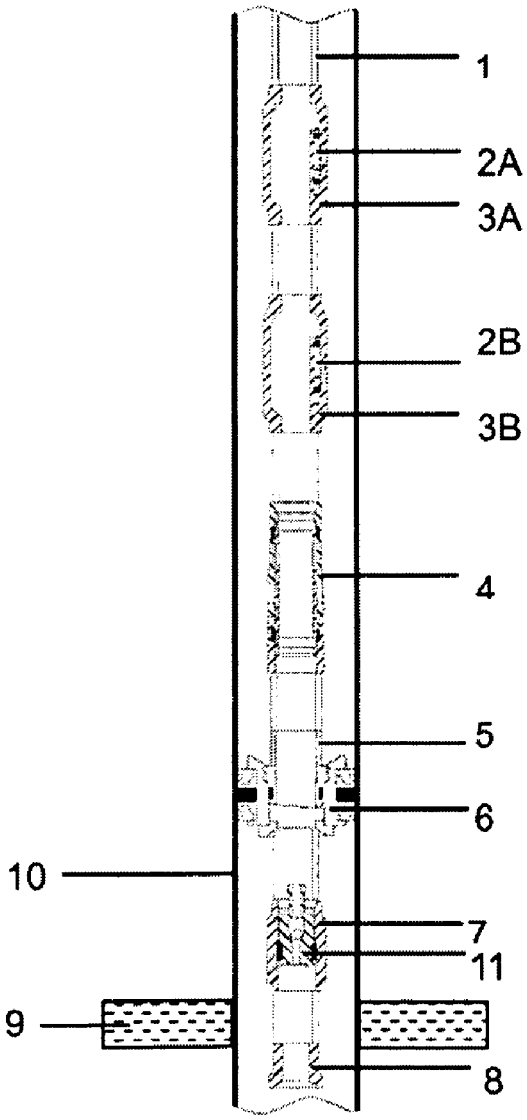
FIG. 2A is a view of a special flushing apparatus in a gas lift well of the present invention, in which a tubing-retrievable check valve has been set into the landing nipple shown in FIG. 1.

Referring to FIG. 2A, a flushing apparatus in a gas lift well of the present invention is illustrated, comprising more than one gas lift valves 2A and 2B carried within side a pocket mandrels 3A and 3B, a sliding sleeve 4, a latch seal assembly 5, a single-bore packer 6, a landing nipple 7, a bell mouth 8 as shown in FIG. 1 and a tubing-retrievable check valve 11 added in the landing nipple 7.

Figure 2B:
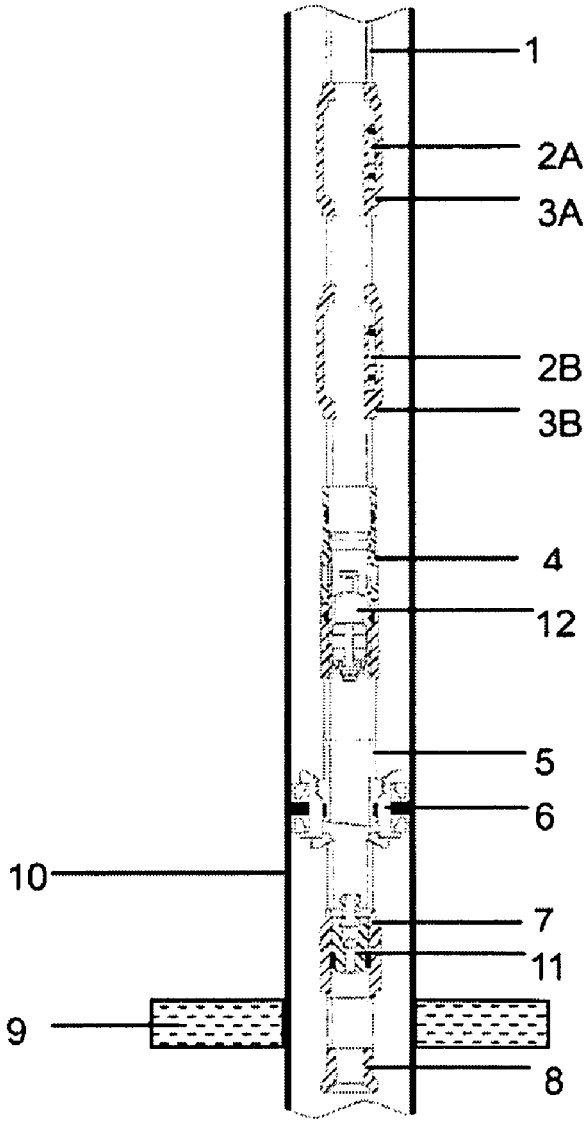
FIG. 2B is a continuation of FIG. 2A, in which the sliding sleeve has been opened and a shifting tool has been landed in it.

In operation of this flushing apparatus shown in FIG. 2B, a sliding sleeve 4 is opened to communicate flushing fluid from the tubing 1 to the casing 10 annuals circularly by jarring down wire-line tool string with a model "B" shifting tool 12. A tubing-retrievable check valve 11 is landed in the landing nipple 7 to divide the tubing 1 into an upper region and a lower region. The casing 10 annulus is sealed above and below the packer 6 as described above. As a result, a pollution-free clear-out operation with the purpose of preventing flushing fluid from pouring into the reservoir is obtained by landing of the tubing-retrievable check valve 11 and sealing of the packer 6, whereby flushing fluid from the casing 10 annulus above the packer 6 is vented through the bypass ports of the sliding sleeve 4 into upper tubing production string 1 above the tubing-retrievable check valve 11 to the surface.

Figure 2C:
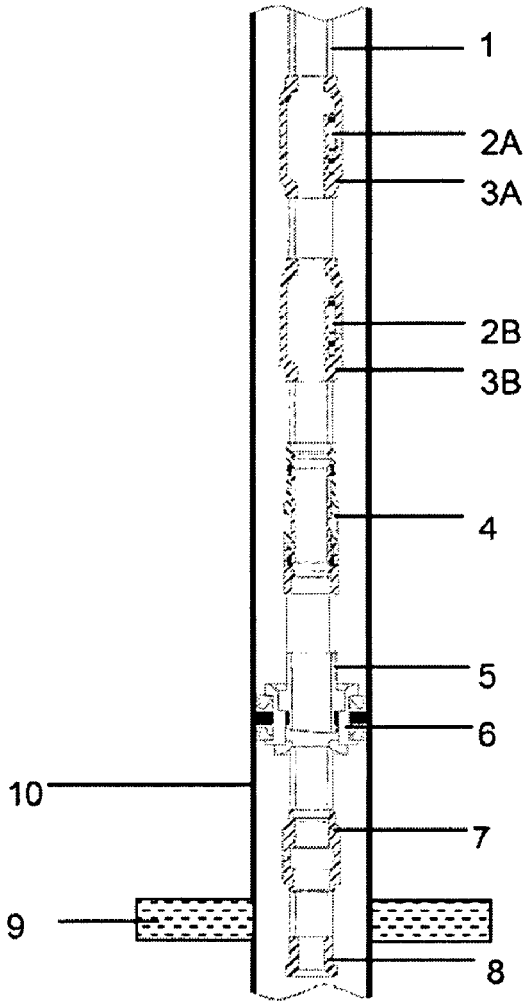
FIG. 2C is a similar view to FIG. 1, in which the tubing-retrievable check valve has been removed from the production string and the sliding sleeve has been closed by jar of the wire-line tool string up and down.

Referring to FIG. 2C, at the end of clear-out operation, the sliding sleeve 4 is closed and the tubing-retrievable check valve 11 is removed from the landing nipple 7 by running standard wire-line tool string with a special tool up or down in the tubing production string 1.

Figure 3A:
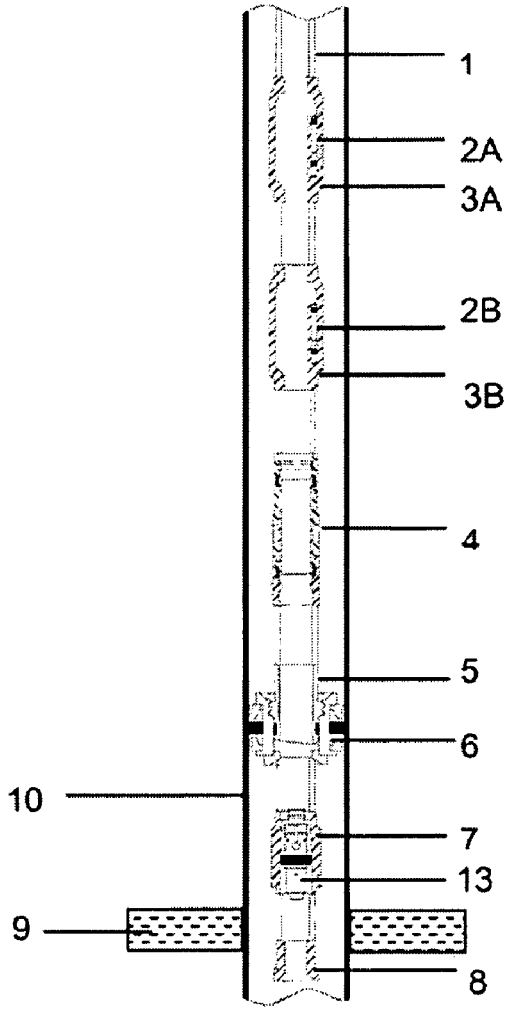
FIG. 3A is a view of a special snubbing apparatus in a gas lift well of the present invention, in which a tubing-retrievable plug has been set into the landing nipple shown in FIG. 1.

Referring to FIG. 3A, a snubbing apparatus in a gas lift well of the present invention is illustrated, comprising more than one gas lift valves 2A and 2B carried within side pocket mandrels 3A and 3B, a sliding sleeve 4, a latch seal assembly 5, a single-bore packer 6, a landing nipple 7 and a bell mouth 8 as shown in FIG. 1. In addition, a tubing-retrievable plug 13 is landed in the landing nipple 7 for shutting off the communication between the tubing production string 1 and the reservoir.

In operation of this snubbing apparatus, well fluid from the tubing 1 and the casing 10 annulus is blew off. After venting operation, fresh water is injected through the casing 10 annulus via gas lift valves 2A and 2B into the tubing 1. The main gate valve of Christmas-tree will be closed until injection fluid from the tubing 1 flow into the surface pipeline. Sealing of the packer 6 and the tubing-retrievable plug 13 within the well bore is utilized to prevent an outflow of the injection fluid from the well bore to the reservoir and an inflow of the produced fluid or gas from the reservoir to the well bore. With the result that the reservoir is protected by the application of the snubbing apparatus in a gas lift well.

Figure 3B:
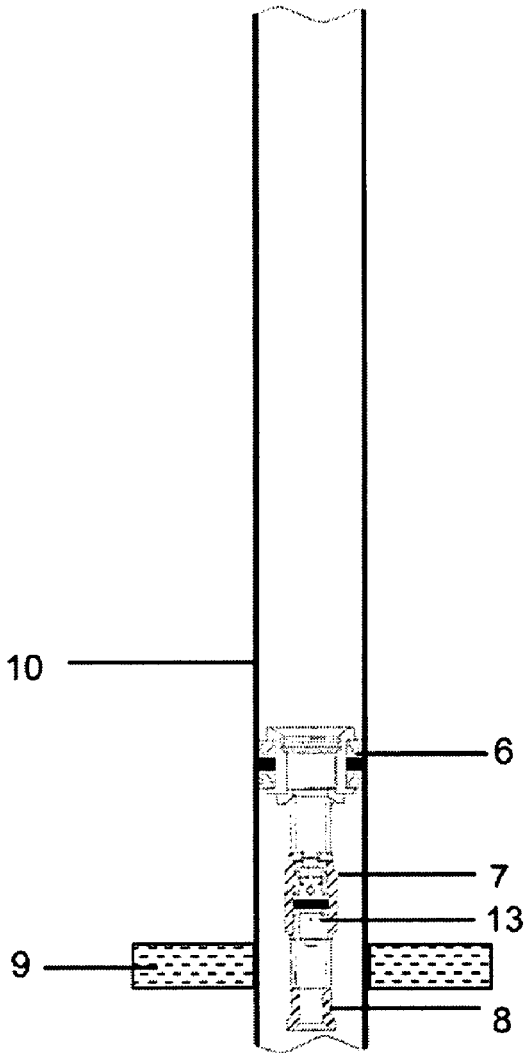
FIG. 3B is a continuation of FIG. 3A, in which the upper production string with the latch seal assembly above the packer has been pulled from the well bore.

Continuing the snubbing operation as described above, the upper tubing production string 1 above the packer 6 with the latch seal assembly 5 was released from the port of the packer 6 by rotating and pulling the tubing production string 1 and removed from the well bore. In FIG. 3B, the packer 6 and the lower tubing production string 1 below the packer 6 has been kept in the well bore.

Figure 3C:
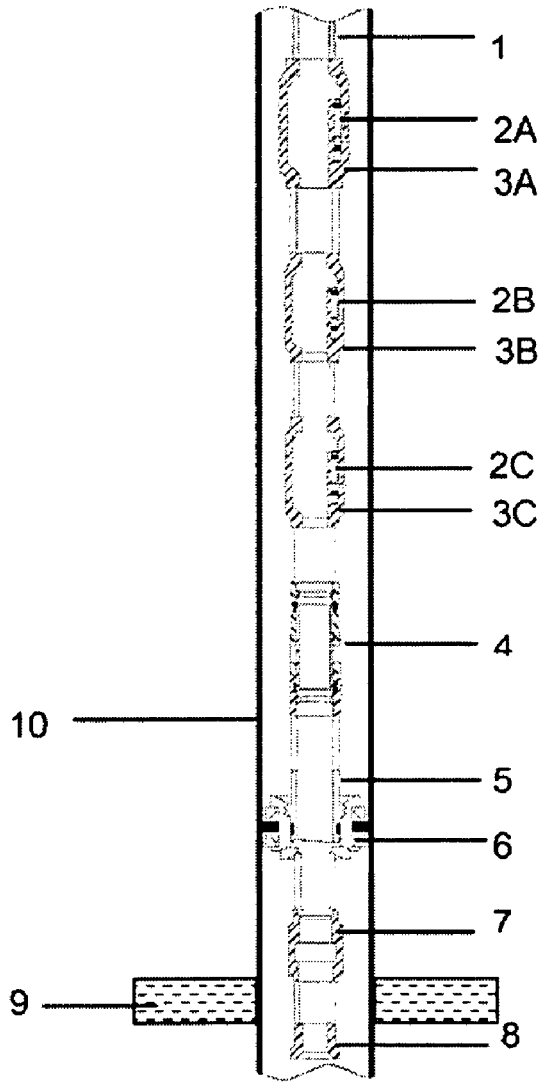
FIG. 3C is yet a similar view to FIG. 1, except that gas lift valves and side pocket mandrels in FIG. 3C are more than those in FIG. 1, in addition, the tubing-retrievable plug shown in FIG. 3B has been pulled from the production string.

In FIG. 3C, according to the gas lift completion design, a new apparatus comprising more than one gas lift valves 2A, 2B and 2C carried within side pocket mandrels 3A, 3B and 3C, a sliding sleeve 4 and a latch seal assembly 5 was run down in the well bore with the latch seal assembly 5 deploying through the port of the packer 6. Afterward, the tubing-retrievable plug 13 was released from the landing nipple 7 by standard wire-line methods. As thus, the similar gas lift completion apparatus shown in FIG. 1 is presented.

While the invention had been described with reference to certain embodiments, it is to be understood that the description is made only by way of example and that the invention is not to be limited to the particular embodiments described herein and that variations and modifications may be implemented without departing from the scope of the invention.

What is claimed is:

1. A gas lift apparatus for use in producing a well, the apparatus comprising:

at least one side pocket mandrel carrying a gas lift valve;

several tubular string threaded in the both ends of every said side pocket mandrel;

a sliding sleeve connected with the tubular string below the lowest side pocket mandrel;

a latch seal assembly mounted in the tubular string below the sliding sleeve;

a packer directly joined with the latch seal assembly;

a landing nipple connected with the tubular string below the packer;

a bell mouth mounted in the tubular string below the landing nipple, located at the end of the gas lift apparatus.

2. The gas lift apparatus of claim 1, wherein the bell mouth has enough large interior diameter to run a testing tool string through.

3. The gas lift apparatus of claim 1, wherein the landing nipple is provided with a locking groove and no-go shoulder combination for location of various wire-line flow control devices.

4. The gas lift apparatus of claim 1, wherein the packer has slips to set in the casing and seal elements to seal the casing annulus.

5. The gas lift apparatus of claim 1, wherein a pawl combination is designed on the latch seal assembly to prevent the disengagement from the packer during well production, and the latch seal assembly can release from the packer by means of rotating or snapping the tubing production string when the tubing-pulling job is required.

6. The gas lift apparatus of claim 1, wherein the sliding sleeve features an internal sleeve and external sleeve with the communication ports, and with the purpose of providing communication between the tubing and casing annulus, the sliding sleeve can be open or closed in limitless times once the internal sleeve is pulled up or down by a standard wire-line tool string with a special shifting tool.

7. The gas lift apparatus of claim 1, wherein the gas lift valves are installed in the side pocket mandrels for unloading pressure and controlling gas injection rate in a gas lift well.

8. The gas lift apparatus of claim 1, wherein the side pocket mandrel is threaded in the tubing production string.

9. A flushing apparatus in a gas lift well, the apparatus comprising:

at least one side pocket mandrel carrying a gas lift valve;

several tubular string threaded in the both ends of every said side pocket mandrel;

a sliding sleeve connected with the tubular string below the lowest side pocket mandrel;

a latch seal assembly mounted in the tubular string below the sliding sleeve;

a packer joined with the end of the latch seal assembly;

a landing nipple connected with the tubular string below the packer;

a tubing-retrievable check valve landed in the landing nipple;

a bell mouth mounted in the tubular string below the landing nipple, located at the end of the flushing apparatus.

10. The flushing apparatus of claim 9, wherein the tubing-retrievable check valve is used to prevent the outflow of the flushing fluid from the tubing production string to the reservoir in the process of well flushing operation, and it can be run into or pulled from the tubing production string by a standard wire-line tool string.

11. A snubbing apparatus in a gas lift well, the apparatus comprising:

at least one side pocket mandrel carrying a gas lift valve;

several tubular string threaded in the both ends of every said side pocket mandrel;

a sliding sleeve connected with the tubular string below the lowest side pocket mandrel;

a latch seal assembly mounted in the tubular string below the sliding sleeve;

a packer joined with the end of the latch seal assembly;

a landing nipple connected with the tubular string below the packer;

a tubing-retrievable plug landed in the landing nipple;

a bell mouth mounted in the tubular string below the landing nipple, located at the end of the snubbing apparatus.

12. The snubbing apparatus of claim 11, wherein the tubing-retrievable plug is used to shut off the communication between the tubing production string and the reservoir, and it can be run into or retrieved from the tubing production string by a standard wire-line tool string.

* * * * *